United States Patent [19]

Maroth

[11] 4,155,662

[45] May 22, 1979

[54] TRANSPARENT TYPEWRITER BAIL

[76] Inventor: Arthur M. Maroth, 70 Washington Post Dr., Wilton, Conn. 06897

[21] Appl. No.: 853,292

[22] Filed: Nov. 23, 1977

Related U.S. Application Data

[63] Continuation-in-part of Ser. No. 806,314, Jun. 13, 1977, abandoned, which is a continuation-in-part of Ser. No. 754,573, Dec. 27, 1976, abandoned.

[51] Int. Cl.[2] ..... B41J 13/02

[52] U.S. Cl. ..... 400/639.1; 400/636.3; 400/641

[58] Field of Search ..... 400/56, 608, 608.1, 400/636.2, 636.3, 637.1, 639, 639.1, 639.2, 641

[56] References Cited

U.S. PATENT DOCUMENTS

| | | | |
|---|---|---|---|
| 1,415,455 | 5/1922 | Kurowski | 400/639.1 |
| 1,516,532 | 11/1924 | Hess | 400/639.2 |
| 1,517,506 | 12/1924 | Hess | 400/639.2 |
| 1,636,129 | 7/1927 | Going | 400/639.1 |
| 1,693,708 | 12/1928 | Dobson | 400/639.1 X |
| 1,817,251 | 4/1931 | Going | 400/637.1 |
| 1,900,102 | 3/1933 | Going | 400/639.1 X |
| 2,163,944 | 6/1939 | Helmond | 400/639.1 |
| 2,356,842 | 8/1944 | Helmond | 400/639.1 X |
| 2,527,859 | 10/1950 | Veltman et al. | 400/639.1 X |
| 2,772,765 | 12/1956 | Maroth | 400/639.1 |

FOREIGN PATENT DOCUMENTS

| | | | |
|---|---|---|---|
| 435977 | 10/1926 | Fed. Rep. of Germany | 400/639.1 |
| 506057 | 8/1930 | Fed. Rep. of Germany | 400/639.1 |
| 719558 | 4/1942 | Fed. Rep. of Germany | 400/639.1 |
| 244359 | 3/1947 | Switzerland | 400/639.1 |
| 278614 | 1/1952 | Switzerland | 400/639.1 |

*Primary Examiner*—Ernest T. Wright, Jr.

*Attorney, Agent, or Firm*—St. Onge, Steward, Johnston, Reens & Noe

[57] ABSTRACT

A transparent typewriter bail is described having a transparent bar and end support elements which seat on a typewriter platen and preserve the integrity of the shape of the transparent bar when it is installed in a typewriter. The end support elements may be in the form of rollers or adjustable elements with which one may vary the spacing between the platen and the transparent bar for optimum performance. Bowing and permanent set distortions of plastic transparent bars are effectively prevented to provide a transparent typewriter bail through which typed text can be read.

15 Claims, 12 Drawing Figures

Fig. 1.
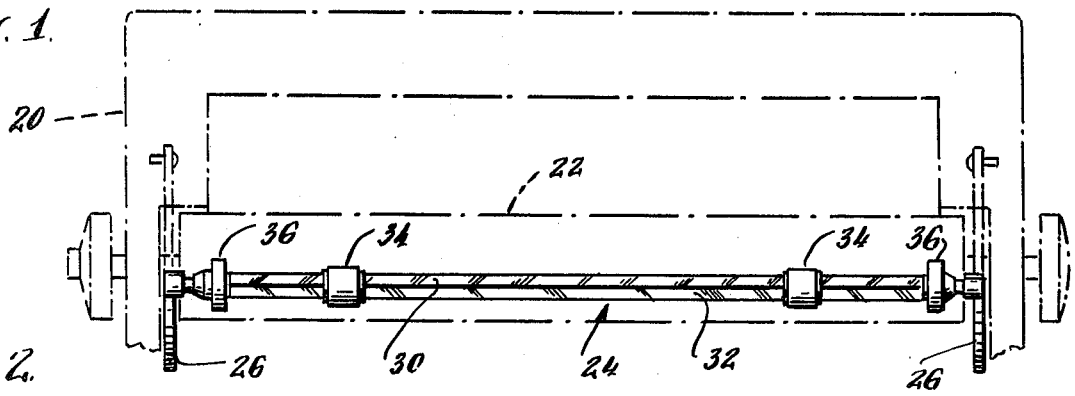
Fig. 2.
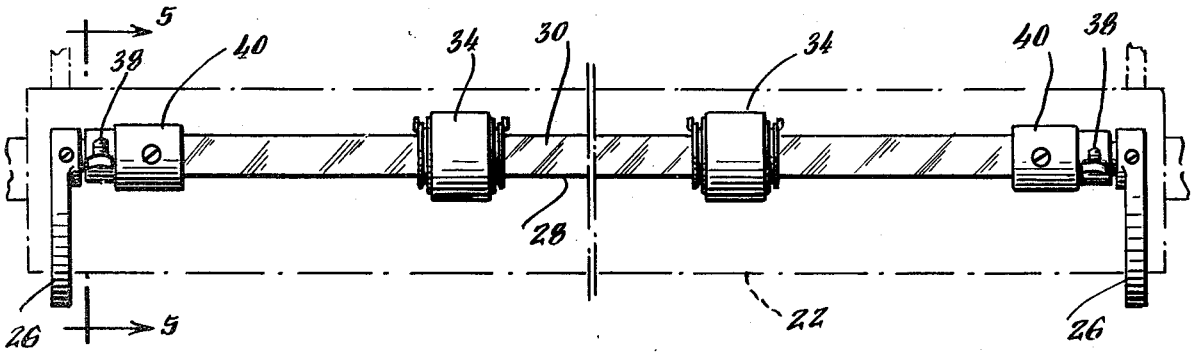
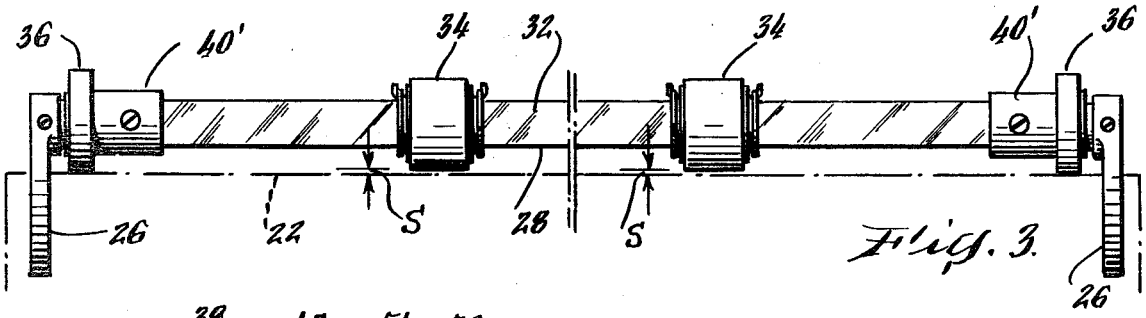
Fig. 3.
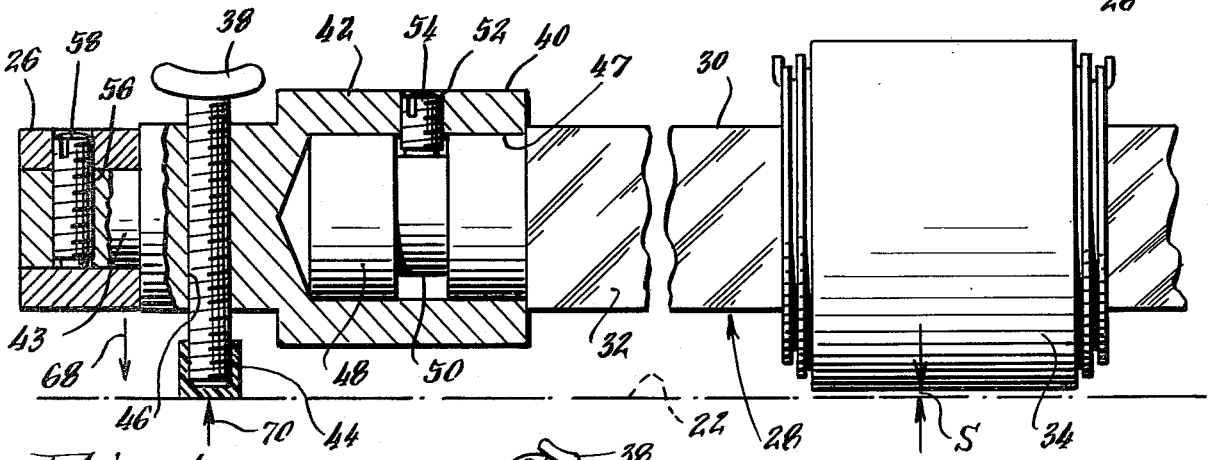
Fig. 4.
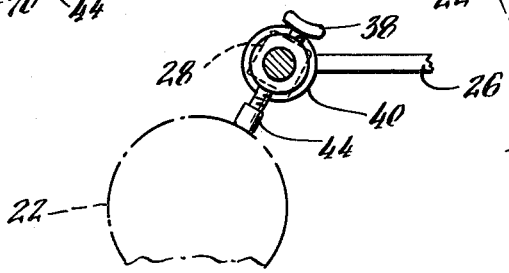
Fig. 5.

TRANSPARENT TYPEWRITER BAIL

CROSS REFERENCES TO RELATED APPLICATIONS

This application is a continuation-in-part of my application Ser. No. 806,314 filed June 13, 1977, now abandoned, which is a continuation-in-part of my application Ser. No. 754,573 filed Dec. 27, 1976, now abandoned.

FIELD OF THE INVENTION

This invention generally relates to typewriter bails, and more particularly to typewriter bails of a type having a transparent bail bar which enables printed material beneath the bar to be read without lifting the bails.

BACKGROUND OF THE INVENTION

Transparent typewriter bails have been described in the art. Such bails have a transparent bail bar through which printed lines can be read. Paper contacting rollers which can be slidably moved along the bar contact underlying paper to be typed on.

An early disclosure of a transparent bail can be found in the German Pat. No. 719,558. As described therein, a transparent bail is provided capable of magnifying the characters typed beneath the bail to facilitate operator reading of the printed line. Transparent bails for a typewriter are described in the Swiss Pat. Nos. 244,359 and 278,614.

In my prior U.S. Pat. No. 2,772,765, dated Dec. 4, 1956, a transparent bail of generally rectangular cross-sections is described to enable direct viewing of a printed line beneath the bail. The transparent bar used with the bail is provided with side located reinforcing strips. This bail, although effective, is difficult and expensive to manufacture, assemble and install.

Conventional typewriter bails have a metal cross bar on which paper rollers can slide. Spring loaded support structures are used at the bar ends to bias the bail against the platen. The spring bias frequently is not evenly applied so that one end of the metal bar may be subjected to a greater clamping force than the other end. Metal cross bars, however, may tolerate such uneqal end loads while retaining proper operational contact between the paper rollers and the paper overlying the platen.

The flexible nature of a rectangular transparent plastic bar used in transparent bails permits undesirable bending or bowing of the bail causing lifting of the center segment. As a result, contact between the paper rollers and paper beneath the bail tends to depend upon the roller position along the bar. When contact between one paper roller and the paper is present but not with the other roller, uneven paper printing occurs, particularly near the bottom of the page where the paper rollers are relied upon to maintain alignment of the paper.

With a transparent bar formed of plastic, a bowed mounting in a typewriter tends to result in a permanent set over a period of time. Unequal spring loading by the bail support structure tends to aggravate such bowing effects on plastic cross bars and eventually causes malfunctioning of the transparent typewriter bail by virtue of a cold flow of the plastic.

In the manufacture of typewriters, it is not currently the practice to employ transparent bails. Hence, it is desirable to be able to install a transparent bail in an existing typewriter in a convenient and quick manner. It is particularly desirable to be able to adjust the transparent bail so that it is suitable to the individual operator for enhanced visibility of the print line underneath the bail.

SUMMARY OF THE INVENTION

With a transparent typewriter bail in accordance with the invention, distortion of the bail is reduced by employing end located support elements between which the transparent bar is effectively suspended. The end support elements are located near the ends of the transparent bar and rest upon the platen of the typewriter. In this manner accurate spacing between the typewriter bail and the platen can be maintained over the length of the bail with corresponding proper line contact between the paper rollers and underlying paper.

As further described with reference to a preferred embodiment, bar mounts are employed which retain ends of the transparent bar in such manner that it can be conveniently rotationally adjusted to suit the individual needs of the typist. The typewriter bail is, therefore, convenient to install in alignment with the eye level of the typist, by rotation of the transparent bar followed with appropriate tightening of fastening elements which are accessible from the front of the typewriter.

The end support elements may be formed of adjustable screws extending through the bar mounts to effectively seat on the platen. The screws are individually adjustable so that precise spacing of the transparent bar from the typewriter platen can be obtained. In another embodiment, the end support elements are formed of end rollers which seat on the platen and are accurately sized to establish the desired spacing between the bar and platen.

It is, therefore, an object of the invention to provide a typewriter bail with enhanced control over its spacing from the typewriter platen. It is a further object of the invention to provide an improved transparent typewriter bail which is convenient to install with satisfactory alignment compatible with the needs of an individual typist. It is still further an object of the invention to provide a transparent typewriter bail which can be made suitable for different typewriters without requiring complex adapter assemblies.

These and other advantages and objects of the invention can be understood from the following description of several embodiments described in conjunction with the drawing.

BRIEF DESCRIPTION OF DRAWING

FIG. 1 is a top plan view of a conventional typewriter employing a transparent bail in accordance with the invention;

FIG. 2 is a front elevational view from the perspective of a typist of an installed transparent bail in accordance with the invention;

FIG. 3 is a front elevational view of an installed transparent typewriter bail in accordance with another form of the invention with the view taken along a plane which is parallel to a plane which intersects the contact line between end support elements and the platen and the platen's axis of rotation;

FIG. 4 is an enlarged partial sectional view of an end support element and a paper roller employed as shown in FIG. 2 on a transparent bar in a typewriter bail in accordance with the invention;

FIG. 5 is a view of the typewriter bail taken along a plane defined by lines 5—5 in FIG. 2;

DETAILED DESCRIPTION OF EMBODIMENTS

Figure 6:
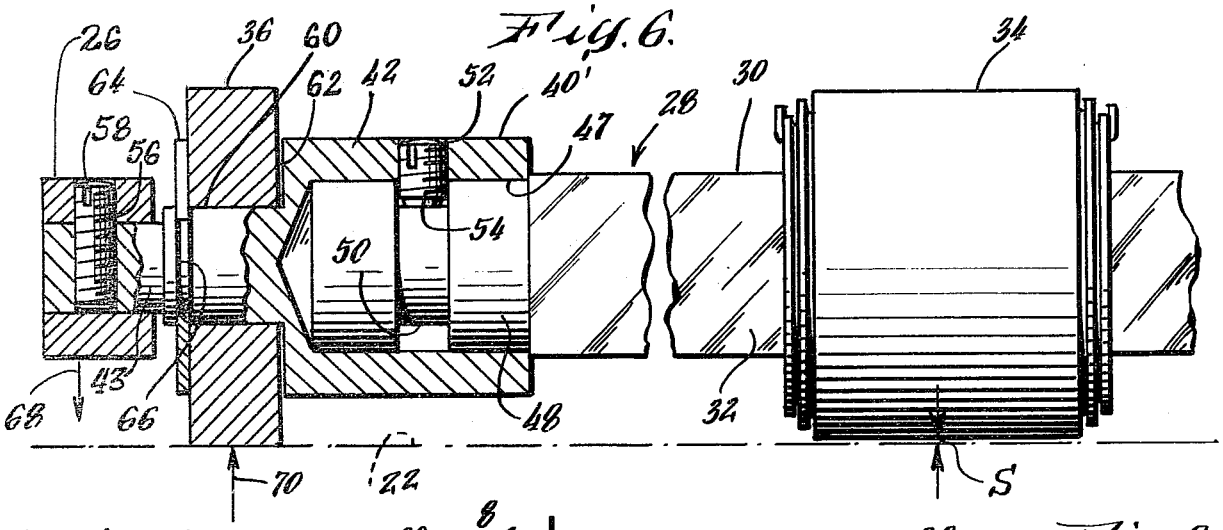
FIG. 6 is an enlarged partial sectional view of an end support element and a paper roller employed as shown in FIG. 3.

With reference to FIG. 1, a conventional typewriter 20 is illustrated in dotted outline. The typewriter 20 depicted is of the type wherein the printing element (not shown) moves along a platen 22. A transparent typewriter bail 24 formed in accordance with the invention is shown supported at the bail ends by a conventional bail support structure 26 which is pivotally mounted to the typewriter 20 to either press the bail 24, with appropriate spring bias, against the platen 22 or pivot the bail 24 away from the platen 22 to enable the insertion of paper. The bail support structure 26 is well known and to the extent that it is well known forms no part of the invention.

The transparent typewriter bail 24 is formed of a rectangular cross-sectional transparent bar 28, which may be formed of a transparent material having opposing transparent faces 30 and opposite generally opaque faces 32. The transparent bar 28 may be formed of a variety of transparent materials such as glass or plastic. A particularly effective material may be a plastic known as methylmethacrylate and marketed in transparent form under the tradenames of Lucite and Plexiglass. The transparent bar 28 carries several paper contacting rollers 34 which are mounted to slide along the transparent bar 28 to any desired position.

It is particularly desirable that the paper rollers 34 maintain even contact with the paper passing around the platen 22 so that the bottom segment of paper sheets can be typed on along lines which are parallel to previous typing. When the dimensions of the bar 28 vary unevenly, such as excessive taper of the bar 28, or when unequally sized paper rollers 34 are used or when excessive bowing of the bar 28 occurs, uneven contact between rollers 34 and the platen 22 arises. Excessive bowing of the typewriter bail 24 tends to introduce visual distortion of the underlying printed line and forces the paper rollers 34 into an edge contact with the underlying paper instead of a line contact. Edge contact is undersirable when it causes streaking on copy paper underlying carbon sheets or the like.

Bowing of the transparent bar 28 and attending edge contact by the rollers 34 tends to result in uneven contact with the underlying paper. This, in turn, causes the paper to skew at an angle to the typewriter bail 24 as the platen 22 is rotated to move the paper to successive typing lines.

One technique for minimizing the effect of these dimensional variations involves the use of roller elements 36 which are mounted near the ends of bar 28 as end support elements. The roller elements 36 are preferably formed of metal and are precisely sized to space the bar 28 at an accurate distance from the platen 22 while absorbing some of the clamping force from the bail support structure 26. As a result, bowing of the bar 28 is reduced while even contact between paper rollers 34 and underlying paper is obtained. The undesirable effect from uneven clamping forces at the ends of the typewriter bail 24 are thus avoided.

FIGS. 2 and 3 illustrate the transparent typewriter bail 24 with greater detail with end support elements in the form of roller elements 36 in FIG. 3 and adjustable end support elements 38 in FIG. 2. The transparent bar 28 has its ends retained in bar mounts 40. The latter, in turn, are connected to the bail support structure 26. The end support elements 38 are in the form of adjustable screws which extend through the bar mounts 40 to seat on the platen 22 and, by rotation, can vary the spacing between the bail bar 28 and platen 22.

As illustrated in FIG. 3, the end support roller elements 36 are so sized that a small effective clearance S between rollers 34 and platen 22 occurs. This clearance is illustrated in the drawing as an actual space; however, it should be understood that the clearance may be so small that the free play of the paper rollers 34 would enable the rollers 34 to rest on the platen 22, thus effectively taking up the clearance S and rendering it unnoticeable. The Figures thus show the clearance S to emphasize that the end support elements 36 or 38 primarily support the bail bar 28. In actual practice, the diameter of the roller shaped end support elements 36 can be less than the diameter of the paper rollers 34 when the free play in the latter is at least equal to the difference in the diameters.

For example, in one practical form of a bail 24 in accordance with the invention, roller shaped end support elements 36 having a diameter of 0.687 inches were used with paper rollers 34 having a diameter of 0.715 inches. The free play in the paper rollers 34, however, was of such magnitude that the end roller elements 36 provided primary support of the bail 24 without undue bending of the transparent bar 28 and without streaking effects on carbon copies. The effective clearance S is thus kept sufficiently small to enable the paper rollers 34 to contact and operatively grip a single sheet of paper. With such clearance S the transparent bar 28 is suspended between end roller elements 36 which absorb most of the clamping pressure from the bail support structure 26.

When the paper to be typed on its very thick or composed of a multiple number of sheets, the paper rollers 34 tend to be lifted away from the platen 22 and correspondingly absorb more of the clamping force from the bail support structure 26. In such case, however, excessive bowing of the bail 24 is inhibited by the presence of end support elements 36 or 38 while the paper rollers 34 maintain proper engagement with the thicker paper.

In some cases the bail 24 may vary excessively in shape and size and the typewriters 20, to which the bails 24 are to be mounted, introduce unequal alignments of the bail ends or unequal clamping forces. In such situations it is preferred that end support elements are adjustable such as with end support elements 38 as illustrated in FIGS. 2, 4 and 5. The end support elements 38 are in the form of screws which may be moved towards or away from the platen 22 depending upon the desired amount of spacing S between paper rollers 34 and the platen 22. The ends of screws 38 are provided with externally smooth plastic shoes 44 to seat on platen 22 without marring of its surface. The shoes 44 fit tightly on the ends of elements 38 and are installed after the elements 38 are threaded through correspondingly threaded diametral through bores 46 in bar mounts 40. The threaded engagement between adjustable end support elements 38 and bar mounts 40 is selected to provide a tight fit to avoid loss of adjustment from typewriter vibrations. Such fit may be achieved with the addition of a suitable frictional material or the introduction of a friction lock on the screw thread.

The bar mounts 40 are preferably made of metal and serve to retain the transparent bar 28 with an end segment 42 and connect to the bail structure 26 with another end segment 43. The end segment 42 has a cylindrical bore 47 sized to snugly receive an end 48 of bar 28. End 48 is cylindrically shaped with an annular capture groove 50 located for alignment with a threaded hole 52 in a bar mount 40. Groove 50 is sized to receive a suitable tightening screw 54. When screw 54 is loosened, the transparent bar 28 may be rotated to the desired position for alignment of the transparent surface 30 for the comfort of the typist.

The other end segment 43 of bar mount 40 is shaped into a central projection sized and selected to engage the bail support structure 26 attached to the typewriter 20. End segment 43 has a through bore 56 sized to receive a screw 58 to firmly connect bar mount 40 to the bail support structure 26. The precise shape of end segment 43 may be selected suitable for connection to such bail support structure 26 as one may encounter with different typewriters.

In FIG. 6 the roller shaped end support element 36 is shown mounted on a bar mount 40'. In the case of bar mount 40', the end support element 36 is rotationally supported by a recessed cylindrical shoulder 60. The roller element 36 is retained on the bar mount 40' between a shoulder 62 and a split washer 64 located in an annular groove 66 formed in shoulder 60.

With the end support elements 36, 38 and bar mounts 40, 40' the bowing of the transparent bar 28 is substantially reduced. This can be appreciated with reference to FIGS. 4 and 6 wherein the clamping force introduced by the bail support structure 26 is indicated by an arrow 68 pointed to the platen 22. The end support elements 36, 38 which seat on platen 22 and are close to the bail support structure 26, absorb most of the downward force as suggested by arrow 70. Even when thick paper is being typed on and the end support elements 36, 38 tend to be lifted off the platen 22 by such paper, the bending of the bar 28 is substantially reduced to a level where proper operation of the bail 24 is preserved.

One may appreciate that the end support elements 36, 38 are preferably located close to the contact point between the bail 24 and bail support structure 26. Such close mounting reduces the force tending to introduce bending of the bar 28. In some cases, however, it may be more suitable to rely upon rollers mounted on a permanent basis on bar 28 near its ends. For example, one could locate a paper roller 34 in a permanent position near the bar ends.

The installation of the transparent bail 24 in a typewriter 20 is conveniently carried out by first removing the existing bail and inserting the transparent bail 24 with the bar mounts 40 attached to the bail support structure 26. Thereupon the fastening screws 54 are loosened so that the transparent bar 28 can be rotated to an optimum viewing position for the typist. The fastening screws 54 are then tightened and the bail 24 is ready for use. When adjustable end support elements such as 38 are employed, these are rotated to establish a clearance S such that a single sheet of paper passed around the typewriter platen 22 is engaged by the paper rollers 34.

Figure 7:
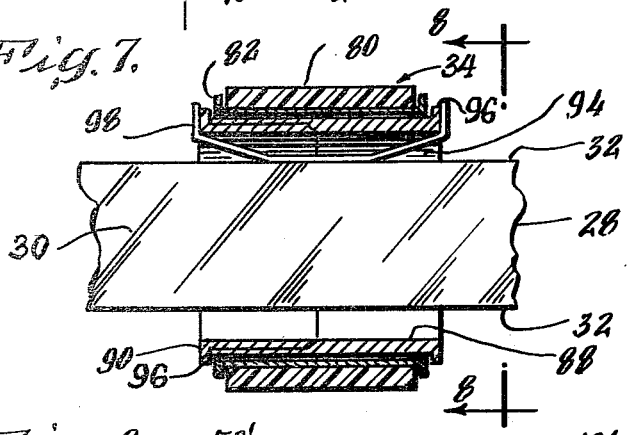
FIG. 7 is a sectional view of a paper contacting roller employed in accordance with the invention.
Figure 8:
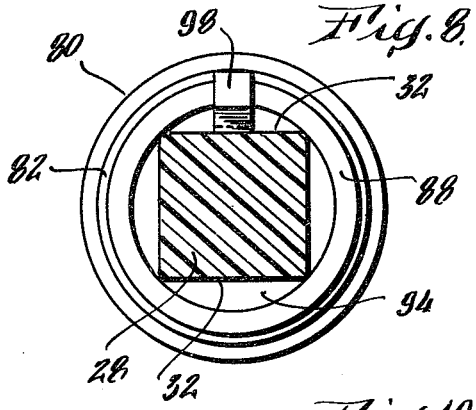
FIG. 8 is a sectional view of a paper roller employed on a transparent typewriter bar taken along a plane identified by the lines 8—8 in FIG. 7.
Figure 11:
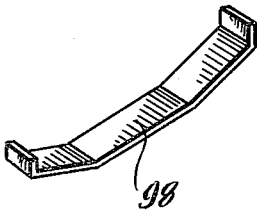
FIG. 11 is a perspective view of a spring employed with a paper roller as shown in FIG. 7.

The paper rollers 34 employed on the transparent bail 24 in accordance with the invention are illustrated in greater detail in FIGS. 7, 8, 11 and 12. The paper rollers 34 include a resilient cylindrical roller surface element 80 which may be made of rubber or plastic and is mounted on a rigid bearing bushing 82. The bushing 82 has an inner cylindrical bore 84 to provide a bearing surface 86. The bearing bushing 82 has its axial ends turned upwardly to assure retention of the resilient surface element 80. The bushing 82 in turn is mounted with clearance for free rotation on a pair of bearing sleeves 88, 90 which frictionally engage each other in telescopic fashion as illustrated in the exploded view of FIG. 12. The external sleeve 88 is provided with an inner enlarged bore 92 having such diameter that the inner sleeve 90 is frictionally received, while forming a continuous, substantially smooth walled, through bore 94 for slidingly engaging the corners of the square-shaped transparent bar 28. Each of the sleeves 88, 90 have annular up-turned end flanges 96 which axially retain bearing bushing 82 with its associated roller surface element 80. A resilient element in the form of a leaf spring 98 is provided as illustrated in FIGS. 7 and 11 in each paper roller 34 to engage a non-transparent side 32 of the square-shaped transparent bar 28 with sufficient sliding friction to maintain a paper roller 34 at its desired position along the transparent bar 28.

Figure 9:
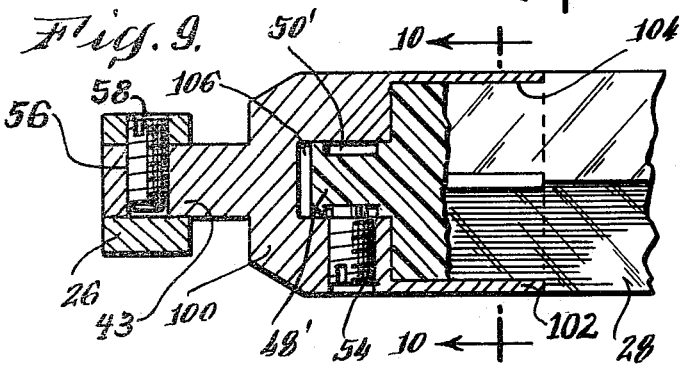
FIG. 9 is a partial sectional view of an alternate form for a bar mount assembled to a transparent bar.
Figure 10:
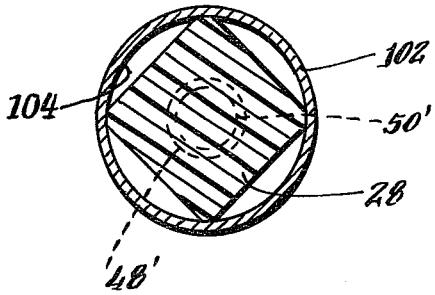
FIG. 10 is a sectional view taken along the plane identified by the lines 10—10 in FIG. 9 of the bar mount and transparent bar assembly.
Figure 12:
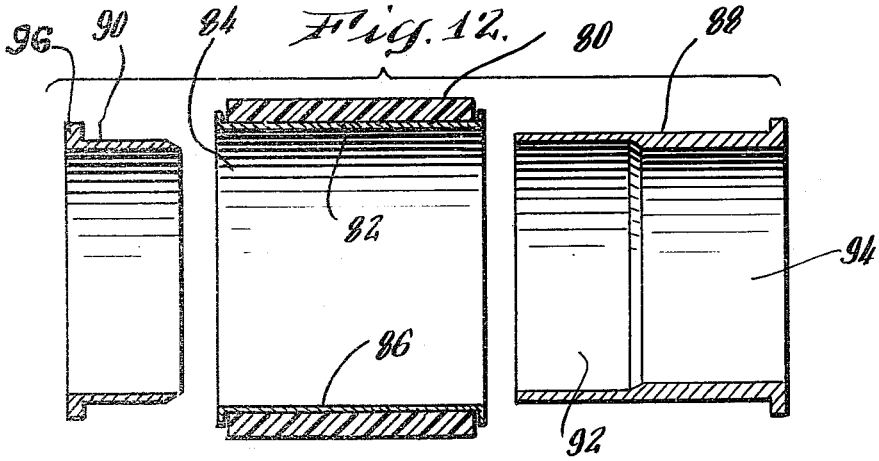
FIG. 12 is a sectional exploded view of parts used to form a paper roller as shown in FIG. 7.

In FIGS. 9 and 10 a modified bar mount 100 is illustrated having an end segment 102 provided with a bore 104 sized to receive an end of the square shaped transparent bar 28. A counter bore 106 is centrally formed in bore 104 to receive a reduced cross-section cylindrically shaped end 48' of bar 28. End 48' has a capture groove 50' for attachment of bar 28 to bar mount 100 as previously described. Bore 104 is so sized as to receive slightly beveled corners of bar 28.

Having thus described a transparent typewriter bail 24 in accordance with the invention, its advantages can be appreciated. The bail with its end support elements maintains operative contact between the paper rollers and underlying paper, even as its bottom edge is no longer retained in alignment by the typewriter platen. When a transparent rectangular shaped typewriter bail is used, its bending due to clamping pressure from the bail support structure is substantially reduced. The end support elements in accordance with the invention may be used on a conventional metal typewriter bail as well as a transparent bail.

What is claimed is:

1. In a typewriter bail having paper rollers mounted on a bail bar for use opposite a platen of a typewriter with a bail support structure which urges the bail in operative position onto the platen, the improvement comprising end support elements effectively mounted near the ends of the bail bar and located to seat on the platen, said end support elements being effective to space the paper rollers with a sufficiently effective clearance relative to the platen to enable the end support elements to provide substantial support of the bail bar, with said clearance further being sufficiently small to enable the paper rollers to operatively engage a sheet of paper passed around the typewriter platen.

2. The improved typewriter bail as claimed in claim 1 wherein said end support elements are formed of rollers whose diameters are selected to provide said effective clearance between the paper rollers and the platen.

3. The improved typewriter bail as claimed in claim 1 wherein the end support elements are each adjustable relative to the platen to establish a desired effective clearance.

4. The improved typewriter bail as claimed in claim 3 wherein said adjustable end support elements are formed of rotatable screws which are oriented to seat on the platen and advance toward or retreat from the platen upon screw rotation.

5. The improved typewriter bail as claimed in claim 4 wherein said rotatable end support elements are each provided with end surfaces formed to slidingly contact the platen.

6. The improved typewriter bail as claimed in claim 4 wherein said rotatable end support elements are each provided with shoes for smooth sliding contact with the platen.

7. A transparent typewriter bail for use opposite a platen of a typewriter with a bail support structure which urges the bail in operative position onto the platen comprising a transparent bar having opposite transparent surfaces formed to enable printed matter to be read through the bar;

a plurality of laterally movable paper rollers mounted on the transparent bar to rotatably engage paper passing around the typewriter platen;

means for mounting the ends of the transparent typewriter bar to the bail support structure; and end support elements effectively mounted near the ends of the transparent bar and located to seat on the platen, said end support elements being effective to space said rollers with a sufficiently effective clearance relative to the platen to enable the transparent bar to be effectively suspended between the end support elements with a reduction of bending of the transparent bar from the force applied by the bail support structure, said clearance being sufficiently small to enable the paper rollers to operatively grip a sheet of paper passed around the typewriter platen.

8. The transparent typewriter bail as claimed in claim 7 wherein said end support elements are each formed of a roller.

9. The transparent typewriter bail as claimed in claim 7 wherein said end support elements are each adjustable relative to the platen to establish a desired effective clearance between the paper rollers and the platen.

10. The transparent typewriter bail as claimed in claim 9 wherein said adjustable end support elements are formed of adjustable screws oriented to be advanced or retracted with respect to the platen.

11. The transparent typewriter bail as claimed in claim 10 wherein said adjustable screws are provided with end surfaces formed to slidingly contact the platen.

12. The transparent typewriter bail as claimed in claim 10 wherein said end support elements are located on said mounting means and adjacent ends of said transparent bar.

13. The transparent typewriter bail as claimed in claim 12 wherein said mounting means includes bar mounts each having at one end a bore, said other end of the bar mount being shaped for attachment to the bail support structure, with said transparent bar having end segments shaped to fit within the bores of the bar mounts, said end segments which fit into the bores being each provided with an annular capture groove, and fastening elements extending radially into the bores of the bar mounts and into the capture grooves to secure the transparent bar with the desired rotational orientation.

14. The transparent typewriter bail as claimed in claim 7 wherein said transparent bar is formed of a plastic material.

15. The transparent typewriter bail as claimed in claim 14 wherein said transparent bar is rectangular in shape with opposing transparent surfaces.

* * * * *